United States Patent [19]

Doehler et al.

[11] 4,021,697

[45] May 3, 1977

[54] CROSSED-FIELD AMPLIFIER

[75] Inventors: Oskar Doehler, Glen Ellyn; Gunter Dohler, Rolling Meadows, both of Ill.; Walter Friz, Dayton, Ohio

[73] Assignee: Warnecke Electron Tubes, Inc., Des Plaines, Ill.

[22] Filed: Dec. 10, 1975

[21] Appl. No.: 639,423

[52] U.S. Cl. ..... 315/39.3; 315/3.5; 313/452

[51] Int. Cl.[2] ..... H01J 25/34

[58] Field of Search ..... 315/39.3, 3.5, 3.6; 313/447, 452

[56] References Cited

UNITED STATES PATENTS

| | | | |
|---|---|---|---|
| 2,680,823 | 6/1954 | Dohler et al. | 315/39.3 |
| 2,770,754 | 11/1956 | Charles | 315/39.3 X |
| 2,807,739 | 9/1957 | Berterottiere | 315/39.3 X |
| 2,888,610 | 5/1959 | Dench | 315/39.3 |
| 2,992,354 | 7/1961 | Lerbs et al. | 315/39.3 X |
| 3,207,946 | 9/1965 | Haus et al. | 315/39.3 |
| 3,378,718 | 4/1968 | Osepchuk | 315/39.3 X |
| 3,508,110 | 4/1970 | Farney | 315/39.3 X |
| 3,588,600 | 6/1971 | Nakayama et al. | 315/39.3 X |

*Primary Examiner*—Saxfield Chatmon, Jr.
*Attorney, Agent, or Firm*—Wegner, Stellman, McCord, Wiles & Wood

[57] ABSTRACT

A crossed-field amplifier with a beam modulating grid for the electron gun has an auxiliary electrode which modifies the electrostatic field and thus the electron beam adjacent the entrance of the amplifier interaction space. Efficiency is improved and incidence of electrons striking the delay line is reduced.

10 Claims, 5 Drawing Figures

CROSSED-FIELD AMPLIFIER

The invention herein described was made in the course of or under a contract or subcontract thereunder, (or grant) with the Department of the Air Force.

FIELD OF THE INVENTION

This invention relates to the structure of the electron gun of a crossed-field amplifier.

DESCRIPTION OF THE PRIOR ART

In a crossed-field amplifier an elongated interaction space is bounced by a delay line and a sole plate. An RF signal applied to the input of the delay line is derived in amplified form from the output. An electron beam established outside the interaction space is injected at the entrance at one end thereof. For maximum efficiency the beam must be injected with appropriate position, velocity and shape. G. S. Kino in a paper entitled "A New Type of Crossed-Field Electron Gun" published in CROSSED-FIELD MICRO-WAVE DEVICES I, edited by E. Okress, Academic Press 1961, pages 164–177, describes some of the design parameters which must be considered. Selection of gun element geometry, electrode potentials and magnetic field strength is largely emperical. Moreover, after the amplifier tube is assembled and sealed, only the potentials and the field strength can be varied, and these only within rather narrow limits.

Theoretical studies have predicted that efficiencies in excess of 45% can be obtained in crossed-field amplifiers. Pratically, however, efficiencies of the order of 30 to 35% are achieved. We believe this is due to improper conditions of the electron beam at injection into the interaction space of the amplifier.

Some crossed-field amplifier guns have a control grid which permits modulation of the beam and reduces noise. However, the grid produces potential disturbances in the injection space which cause significant number of electrons to strike the delay line with the result that the line may burn out.

SUMMARY OF THE INVENTION

In accordance with the principal feature of the invention an auxiliary electrode is placed in the gun, preferably between the accelerating electrode and the delay line. The auxiliary electrode potential modifies the electrostatic field in the injection space, providing a direct control over the electron beam characteristics. The potential on the auxiliary electrode is generally somewhat less than that of the accelerating electrode and the delay line, compressing the beam and improving its edge definition.

A further feature of the invention is the provision of a second auxiliary elecrode between the cathode-grid assembly and the sole plate.

Further features and advantages of the invention will be apparent from the following specification and from the drawings in which.

Figure 1:
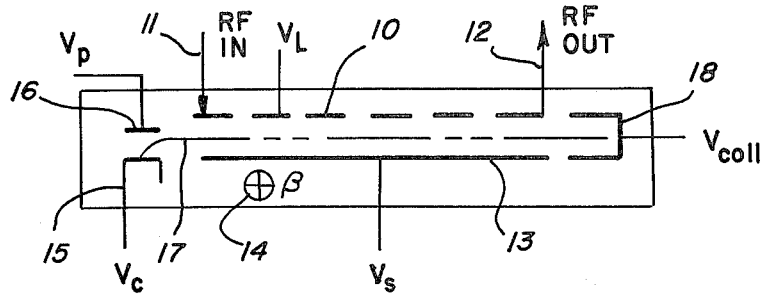
FIG. 1 is a simplified schematic representation of the basic elements of a crossed-field amplifier.

A typical crossed-field amplifier, FIG. 1, has a delay line 10 with input and output connections 11 and 12 for the RF signal. The delay line is an elongated planar element. A sole plate 13, also an elongated planar element, is aligned with delay line 10. A magnetic field B, established by magnets and pole pieces which are not shown, extends at right angles to the plate of the paper as indicated by the symbol 14. A beam of electrons from cathode 15 are attracted towards an accelerating anode 16. Because of the transverse magnetic field the electrons which are acceleratad from cathode 15 towards anode 16 follow a curved path to the right as indicated at 17 and are injected into the interaction space between the delay line 10 and sole plate 13. At the remote end of the interaction space the electrons are received by a collector 18. The space between cathode 15, anode 16 and the entrance to the interaction space is an injection space in which the electrons from cathode 15 are formed into a beam with the appropriate cross-section, position, potential and velocity for efficient operation of the amplifier.

In a typical amplifier the cathode and a sole plate are at a negative potential with rspect to ground and the accelerating anode, delay line and collector are at a positive potential with respect to ground. The potential of the accelerating anode $V_p$ is generally about half that of the delay line $V_1$.

Figure 2:
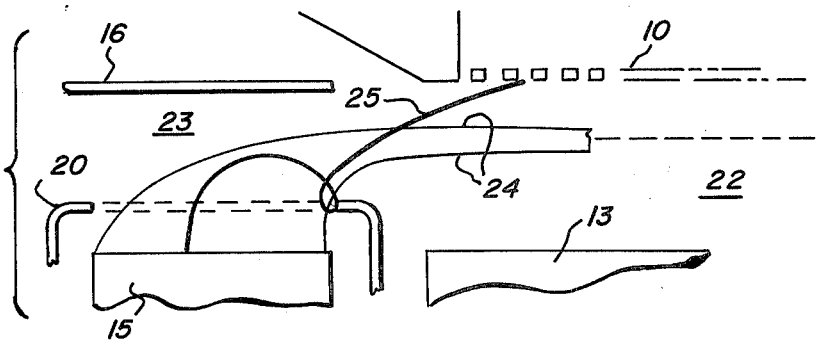
FIG. 2 is a diagram of an electron gun control grid for a crossed-field amplifier.

The electron gun of some crossed-field amplifiers is provided with a control grid 20, FIG. 2, for modulating the electron beam. The control grid, may, for example, have a planar surface with a plurality of alternate teeth and slots which extend generally parallel with the longitudinal axis of the interaction space 22. The structure of grid 20 disturbs the electric field conditions in the injection space 23 so that a significant portion of the electrons cathode 15 do not travel within the edges 24 of the main beam. Rather, these electrons follow a cycloidal trajectory as illustrated at 25 and strike the delay line 10. This condition reduces efficiency of the amplifier and if the delay line current becomes excessive, burns out the line.

Figure 3:
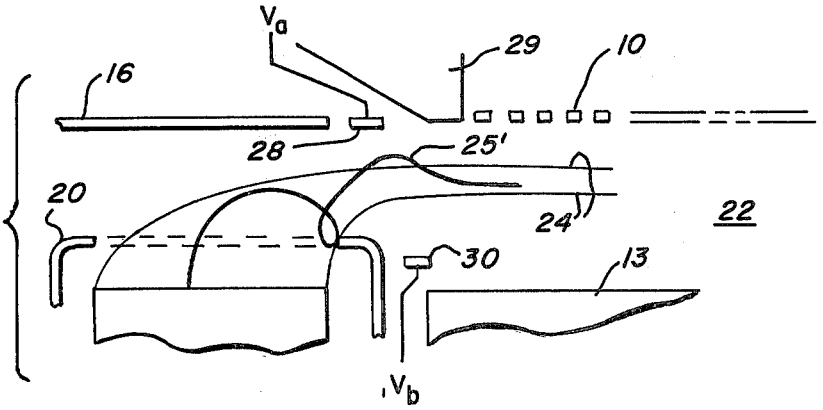
FIG. 3 is a diagram of the electron gun of a crossed-filed amplifier with auxiliary electrodes in accordance with the invention.

In accordance with the invention as illustrated in FIG. 3, an auxiliary electrode 28 is located between the accelerating electrode 16 and the end member 29 of delay line 10. The voltage applied to auxiliary electrode 28 modifies the electric field in the transition region between the electron gun and the interaction space 22. If the field resulting from auxiliary electrode potential Va is lower than that of voltages $V_p$ and $V_1$ applied to the accelerating anode and the delay line, the electron beam is shifted closer to sole 13. Morover, the space charge developed in the transition region between the injection space and the interaction space compresses the beam improving the definition of the beam edges 24. Electrons following a cycloidal trajectory 25 are repelled and do not intercept delay line 10.

A second auxiliary electrode 30, positioned between grid 20 and sole plate 13 has a voltage $V_b$ applied thereto. If $V_b$ is more negative than the potential of grid 20 and sole 13, the electron beam is shifted towards delay line 10 and its size further reduced.

Figure 4:
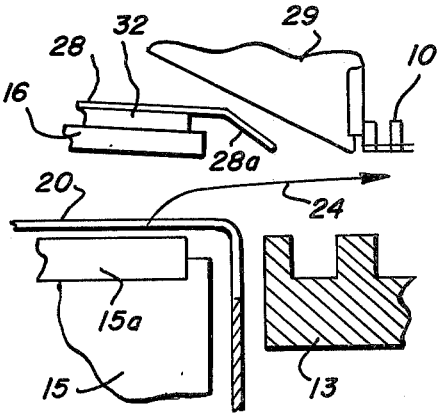
FIG. 4 is a fragmentary diagram illustrating a mounting for the auxiliary electrode.
Figure 5:
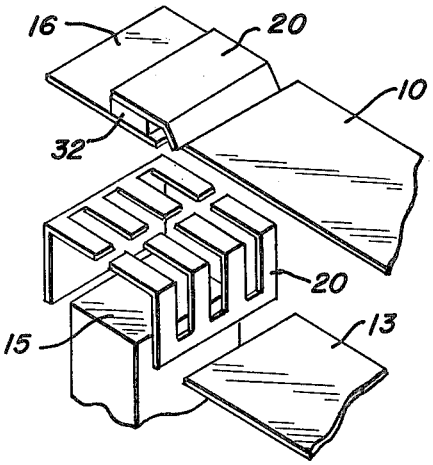
FIG. 5 is a fragmentary perspective of FIG. 4.

FIG. 4 and 5 illustrate diagramatically a physical embodiment of the gun portion of a crossed-field amplifier incorporating the invention. The emissive surface 15A of cathode 15 is positioned adjacent grid 20, facing the accelerating anode 16, cantilevered plate supported from its left end. The slots **20*a* of the grid extend into the wall facing the sole 13 to minimize interference of the grid with the electron beam. Auxiliary electrode 28 is a plate of substantially the same width as accelerating electrode 16 with its end portion 28***a* extending into the space between accelerating anode 16 and the end member 29 of delay line 10. In one specific tube, plate 28 has a 5 mil thickness and extends into a gap having a width of the order of 15–20 mils. The end surface of plate portion 28*a* is spaced farther from the electron beam 24 than accelerating anode 16 and delay line 10, 29. Thus, if the potential applied to auxiliary electrode 28 is the same as that applied to the accelerating anode and delay line, the field strength in the vicinity of the auxiliary electrode is less than that adjacent the accelerting anode and delay line and the effect is similar to the application of a lower voltage to the auxiliary electrode.

The auxiliary electrode is preferably mounted directly to the rear surface of accelerating electrode 16. A block of insulating material 32 has a metal coating on each surface. One surface is brazed to the accelerating electrode with the auxiliary electrode brazed to the opposite surface.

In practice, the voltage applied to the auxiliary electrode is selected experimentally for maximum power output. In one set of experiments where the operation of a tube with one auxiliary electrode 28 and an auxiliary electrode potential Va of the order of one third the accelerating anode potential was compared with operation of the tube having both elements at the same potential. An increase in efficiency from about 34% to about 39% was achieved with the reduced auxiliary electrode potential. Other tests have demonstrated that the level of current intercepted by the delay line varies directly as a function of the auxiliary electrode potential.

We claim:

1. In a crossed-field amplifier having an elongated interaction space with signal input and output terminals and an entrance for an electron beam and a source of electrons adjacent said entrance for establishing an electron beam and an anode for directing said beam into said interaction space and a grid between the source and the anode for modulating the flow of electrons from the source, the improvement comprising:

an auxiliary electrode adjacent the entrance of said interaction space for modifying the electron beam entering the interaction space.

2. The crossed-field amplifier of claim 1 in which said auxiliary electrode contributes to an electric field which modifies the shape of the electron beam.

3. The crossed-field amplifier of claim 1 in which said auxiliary electrode contributes to a field which modifies the position of the electron beam with respect to the longitudinal axis of the interaction space.

4. The crossed-field amplifier of claim 1 in which said auxiliary electrode contributes to a field which modifies the potential of the electron beam with respect to the means defining the interaction space.

5. The crossed-field amplifier of claim 1 in which said auxiliary electrode contributes to an electric field which modifies the velocity of the electron beam.

6. The crossed-field amplifier of claim 1 in which said source includes a cathode located at one side of the entrance of the interaction space and said auxiliary electrode is located on the other side of the entrance of the interaction space.

7. The crossed-field amplifier of claim 6 including a second auxiliary electrode located between the cathode and the means defining the interaction space, said entrance being between the auxiliary electrodes.

8. In a crossed-field amplifier having an elongated interaction space defined by a delay line with signal input and output connections and a sole plate, said interaction space having an entrance at one end thereof, means providing a magnetic field extending across the interaction space, means providing an electric field between said delay line and sole plate, and an electron beam and injecting the beam into the entrance of the interaction space, said source including a cathode adjacent said sole plate, a grid for modulating the flow of electrons from the cathode and a beam accelerating electrode adjacent said delay line, the improvement comprising:

an auxiliary electrode in the form of a plate, the plate being adjacent the entrance of said interaction space and having an edge presented to the electron source and located on the opposite side of the interaction space entrance from the electron source for modifying the electron beam entering the interaction space wherein said plate is mounted on and insulated from the surface of the beam accelerating electrode remote from said source and said edge being extended into the space between the accelerating electrode and the delay line.

9. The crossed-field amplifier of claim 8 in which said grid has a planar surface with a plurality of alternate elongated teeth and slots extending generally parallel with the axis of the interaction space, and said auxiliary electrode is generally rectangular and has its major dimension extending transversely to the interaction space axis and parallel with said planar grid surface.

10. The crossed-field amplifier of claim 9 in which said auxiliary electrode is the edge of a sheet of metal having a thickness of the order of 0.005 and the width of the order of the width of the anode and delay line.

* * * * *